US006283491B1

(12) United States Patent
Bush et al.

(10) Patent No.: US 6,283,491 B1
(45) **Date of Patent: *Sep. 4, 2001**

(54) SPORTBOARD FASTENER

(75) Inventors: Duane Bush, Salt Lake City, UT (US); Cliff Hufstedler, Walnut Ridge; Don Kirby, Reyno, both of AR (US)

(73) Assignee: MacLean-Esna, L.P., Pocahontas, AR (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/812,682

(22) Filed: Mar. 6, 1997

(51) Int. Cl.[7] ..... A63C 9/00
(52) U.S. Cl. ..... 280/611; 411/303
(58) Field of Search ..... 280/607, 611, 280/623, 633, 11.32; 411/107, 111, 303, 360

(56) References Cited

U.S. PATENT DOCUMENTS

| | | | | |
|---|---|---|---|---|
| 3,917,299 | * | 11/1975 | Anderson | 280/11.13 |
| 4,367,060 | * | 1/1983 | Berecz | 411/303 |
| 4,728,116 | | 3/1988 | Hill . | |
| 4,741,550 | | 5/1988 | Dennis . | |
| 4,973,073 | | 11/1990 | Raines et al. . | |
| 4,979,760 | | 12/1990 | Derrah . | |
| 5,028,068 | | 7/1991 | Donovan . | |
| 5,035,443 | | 7/1991 | Kincheloe . | |
| 5,044,654 | | 9/1991 | Meyer . | |
| 5,054,807 | | 10/1991 | Fauvet . | |
| 5,085,455 | | 2/1992 | Bogner et al. . | |
| 5,143,396 | | 9/1992 | Shaanan et al. . | |
| 5,145,202 | | 9/1992 | Miller . | |
| 5,172,924 | | 12/1992 | Barci . | |
| 5,190,311 | | 3/1993 | Carpenter et al. . | |
| 5,207,445 | * | 5/1993 | Hoelzl | 280/607 |
| 5,236,216 | | 8/1993 | Ratzek . | |
| 5,261,689 | | 11/1993 | Carpenter et al. . | |
| 5,299,823 | | 4/1994 | Glaser . | |
| 5,344,179 | | 9/1994 | Fritschi et al. . | |
| 5,354,088 | | 10/1994 | Vetter et al. . | |
| 5,356,170 | | 10/1994 | Carpenter et al. . | |
| 5,409,244 | | 4/1995 | Young . | |
| 5,417,443 | | 5/1995 | Blattner et al. . | |
| 5,474,322 | | 12/1995 | Perkins et al. . | |
| 5,480,176 | | 1/1996 | Sims . | |
| 5,505,477 | | 4/1996 | Turner et al. . | |
| 5,520,405 | | 5/1996 | Bourke . | |
| 5,520,406 | | 5/1996 | Anderson et al. . | |
| 5,544,909 | | 8/1996 | Laughlin et al. . | |

* cited by examiner

*Primary Examiner*—Robert J. Oberleitner
*Assistant Examiner*—C. T. Bartz
(74) *Attorney, Agent, or Firm*—Jerry L. Mahurin

(57) ABSTRACT

A generally inverted "T" shaped, resiliently self locking, integral sportboard fastener is adapted to be received in a countersunk aperture formed in a sportboard such as a snowboard, ski, boogie board, skateboard or any other board which supports a person and has one or more structures attached thereto. The fastener comprises a noncircular base portion to be received within a countersink defined in the sportboard. The base and the countersink comprise two parallel sides and two opposite concentric arcs forming two opposite ends. A generally cylindrical integral ferrule portion extends upwardly from the base, through a bore defined in the sportboard, concentric with the countersink. The ferrule defines internal threads to receive a screw to secure a binding or other fixture to the sportboard. An internal annulus portion is defined at the juncture of the base and ferrule. A generally circular, preferably nylon, resilient insert ring is disposed within the annulus. The base defines a central orifice aligned with the annulus. The orifice receives the resilient ring and a bearing plate which retains the resilient insert in place. The bearing plate is held in place by a crimp shoulder formed in the orifice. The bottom of the base is disposed generally flush with the face of the sportboard and covered by the resin or the like covering the face of the sportboard. The top of the ferrule extends through the resin covering the top of the sportboard, flush with a top surface of the resin.

19 Claims, 4 Drawing Sheets

SPORTBOARD FASTENER

BACKGROUND OF THE INVENTION

1. Field of the Invention

The present invention broadly relates to fasteners for securing a support structure such as a binding device to a sportboard such as a snowboard, water ski, snow ski, boogie board, skateboard or the like. Specifically, the present invention is a resiliently self locking anchor intended to be imbedded in a sportboard for attaching bindings or other structures to the sportboard. Art pertinent to the subject matter of the present invention can be found in United States Patent Class 280, Subclasses 607 and 611.

2. State of the Art

Numerous patents have been issued on ski bindings and related fixtures. Plateless snowboard bindings are disclosed in Young, U.S. Pat. No. 5,409,244. Hunter, U.S. Pat. No. 5,096,217 and Hunt, U.S. Pat. No. 2,526,137, each disclose metal plates laminated into the structure of a ski to receive binding screws. Kautzky, U.S. Pat. No. 4,188,044 and Gorliez, U.S. Pat. No. 5,211,419, each disclose tabs associated with ski bindings, intended to index with the ski body.

Flexible anchoring for bindings is taught by Gertsch, U.S. Pat. No. 4,438,948; Haff U.S. Pat. No. 3,917,298; and Baggio U.S. Pat. No. 5,167,424. Gertsch teaches the use of a resilient baseplate to provide flexibility. Haff provides a deformable base which can be adjusted to provide toe-in and toe-out. Baggio provides a spring loaded vibration dampening bolt to attach bindings.

Some patents disclose screw retainers to assist in installing bindings. These devices are intended to hold the screws in place in the bindings to facilitate alignment and installation. Beyl, U.S. Pat. No. 4,158,377 discloses a destructible retainer. Salomon, U.S. Pat. No. 3,917,300; Mickiewicz, U.S. Pat. No. 5,082,407; and Riegler, U.S. Pat. No. 4,813,700, all disclose deformable retainers. Vitali, U.S. Pat. No. 5,380,031 and Muad, U.S. Pat. No. 4,512,698 both disclose a pair of offset holes in the bindings to hold assembly screws in place.

Several patents disclose methods for attaching and/or securing bindings to skis. Matsuda, U.S. Pat. No. 3,915,465, discloses through-bolts countersunk into the face of the ski. Sedlmair, U.S. Pat. No. 4,640,524, discloses a resilient tongue disposed within the screw bores of a binding to engage and lock a screw in place. A binding screw anchor, similar to a conventional lag or wall "bullet" anchor, is disclosed in Provence, U.S. Pat. No. 5,082,410. Dietlein, U.S. Pat. No. 4,097,061, discloses a self tapping internally/externally threaded bushing. This bushing in obviously intended to be screwed into a blind bore.

Mayr, U.S. Pat. No. 5,016,901, and Hoelzl, U.S. Pat. No. 5,207,445 each disclose the use of inserts within the binding screw bores. Mayr teaches the use of layered cores to provide adjustable mounting. The inserts in Mayr are alternating layers of a rubber material and rigid material, (metal or fiberglass). Hoelzl teaches similar use of layered material in conjunction with a bushing or flared end insert. However, In both of these patents, the rubber and fiberglass material are all disposed externally, away from the threads. The rubber material is intended to provide flexibility to the securements. Hoelzl and Anderson, U.S. Pat. No. 3,917,299, each disclose the use of a ski binding attachment having a generally inverted "T" shaped cross-section. The Anderson anchor is installed generally flush with the sole of a ski.

The prior art fails to disclose a snowboard, ski or other sportboard related reference that teaches the use of a nylon insert to lock the threaded elements anchoring a snowboard or ski binding, particularly in conjunction with an anchor which has a shape which further enhances performance by increasing the bearing surface and spreading the angle of stress on the sportboard-anchor interface.

SUMMARY

Our invention provides a vibration and stress resistant locking anchor intended to be embedded in a sportboard such as a water ski, a snowboard, snow ski, boogie board or skateboard in a concentric countersunk mounting hole to mount bindings or other elements such as skateboard carriages.

Our fastener for use with a sportboard comprises a base sized to be received within a countersink defined in the face of a sportboard. Preferably, the base and countersink have corresponding noncircular shapes to provide a tight fit. Specifically, the base and countersink are generally rectangular with rounded ends. An integral ferrule extends upwardly from the base through a bore defined in the sportboard concentric with said countersink. Internal threads are defined within the ferrule portion to receive a screw for mounting a binding or other sportboard element. An internal annulus portion is defined in the lower portion of the ferrule portion, positioning it generally at the juncture of the base and the ferrule. A generally circular resilient insert is disposed within the annulus. A screw threaded into the ferrule of the anchor contacts the resilient insert. This prevents the screw from backing out as a result of flexure of the sportboard, vibration and lateral mechanical stresses.

Preferably, the resilient insert is nylon, red in color. The shape it defines might be considered a washer-like or ring shape. Additionally, in the preferred embodiment, the base defines a central orifice having a diameter approximately equal to or slightly greater than the external diameter of the resilient ring, to allow insertion of the ring into the annulus. The floor of the annulus and the floor of the ferrule's threaded bore is defined by a plate crimped into the base orifice. The preferred shape of the base is noncircular. This shape aids in preventing rotation of the anchor while the binding mounting screw is tightened. The preferred shape, in plan, is generally ovoid with flat sides. This shape has the aforementioned advantage over a circular shape of indexing the anchor in place, preventing rotation while tightening the binding screws. Additionally, the rounded ends provide a greater bearing area than would be provided by a strictly rectangular base. Furthermore, the rounded ends prevent the corners of the anchor from digging in as easily as the corners of a truly rectangular base.

Therefore, a primary object of the present invention is to provide an integral self locking fastener for a sportboard.

Further, a primary object of the present invention is to provide an integral resiliently self locking anchor intended to be imbedded in the body of a sportboard for attaching bindings or other structures to the sportboard using screws.

Specifically, an object of the present invention is to provide a resiliently self locking sportboard binding screw anchor.

More specifically, an object of the present invention is to provide a resiliently self locking binding screw fastener for snowboards, snow skis, water skis and boogie boards.

Also, an object of the present invention is to provide a resiliently self locking skateboard carriage mounting screw anchor.

An object of the present invention is to provide a sportboard binding anchor having a nylon insert to engage and lock a binding or mounting, screw or bolt against loosening.

A specific object of the present invention is to provide a sportboard binding anchor having a red nylon insert.

An object of the present invention is to provide a sportboard binding fastener which resists lateral forces to maintain a binding or mounting screw against rotation.

An object of the present invention is to provide a sportboard binding fastener which resists vibration to maintain a binding or mounting screw against rotation.

An object of the present invention is to provide a sportboard fastener which resists mechanical forces to maintain a binding or mounting screw against rotation.

An object of the present invention is to provide a sportboard fastener which resists forces applied to the binding or mounting screw by board flexure to maintain a binding or mounting screw against rotation.

An object of the present invention is to provide a sportboard binding fastener which widely distributes bearing stresses.

A related object of the present invention is to provide a sportboard binding anchor having a base which employs both flat sides to index the fastener in place and rounded ends to prevent the corners of the base from digging into the material comprising the body of the sportboard.

An object of the present invention is to provide a binding anchor which is embedded in the body of a sportboard with the bottom of the anchor flush with the face of the sportboard, covered by resin or the like, and with the top of the anchor extending through the top surface of the ski to contact a mounted binding plate.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
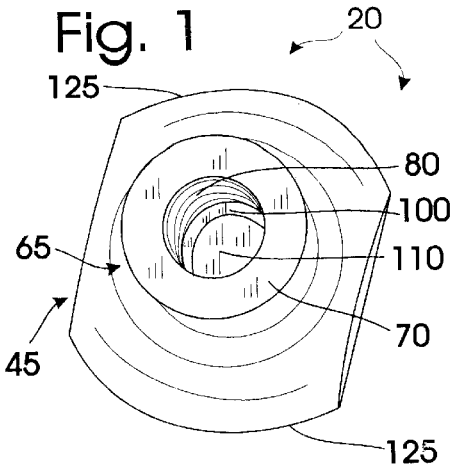
FIG. 1 is an enlarged isometric view of a our sportboard fastener.
Figure 2:
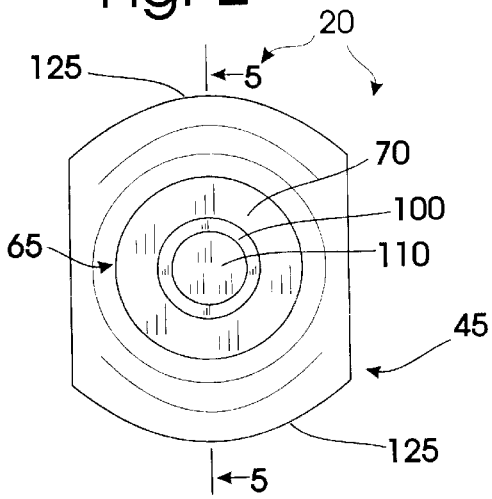
FIG. 2 is an enlarged top plan view of our fastener.
Figure 3:
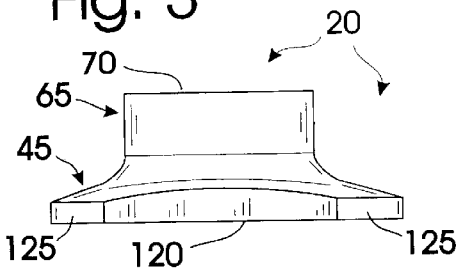
FIG. 3 is an enlarged side elevational view of our fastener.
Figure 4:
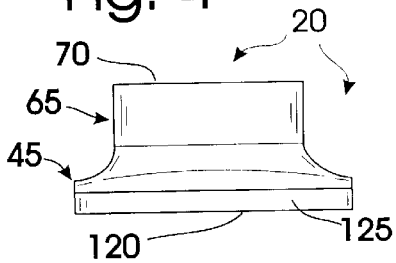
FIG. 4 is an enlarged end elevational view of our fastener.
Figure 5:
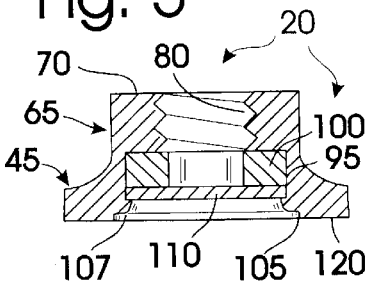
FIG. 5 is an enlarged cross sectional view of our fastener taken generally along lines 5—5 of FIG. 2.
Figure 6:
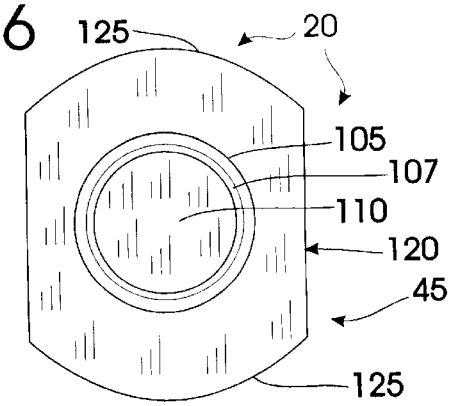
FIG. 6 is an enlarged bottom plan view of our fastener.
Figure 7:
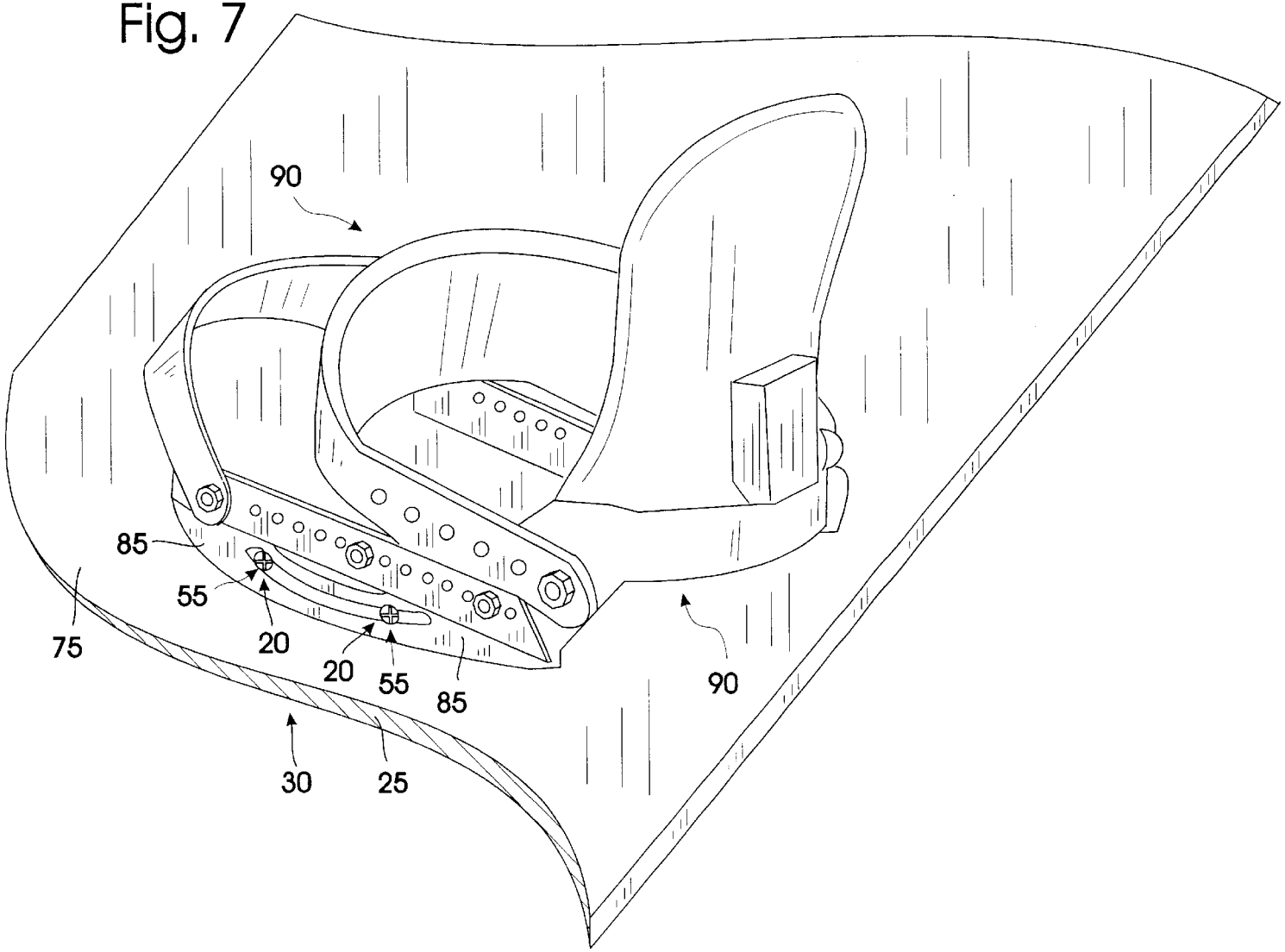
FIG. 7 is a partially fragmented isometric view of a typical snowboard binding mounted to a snowboard.
Figure 8:
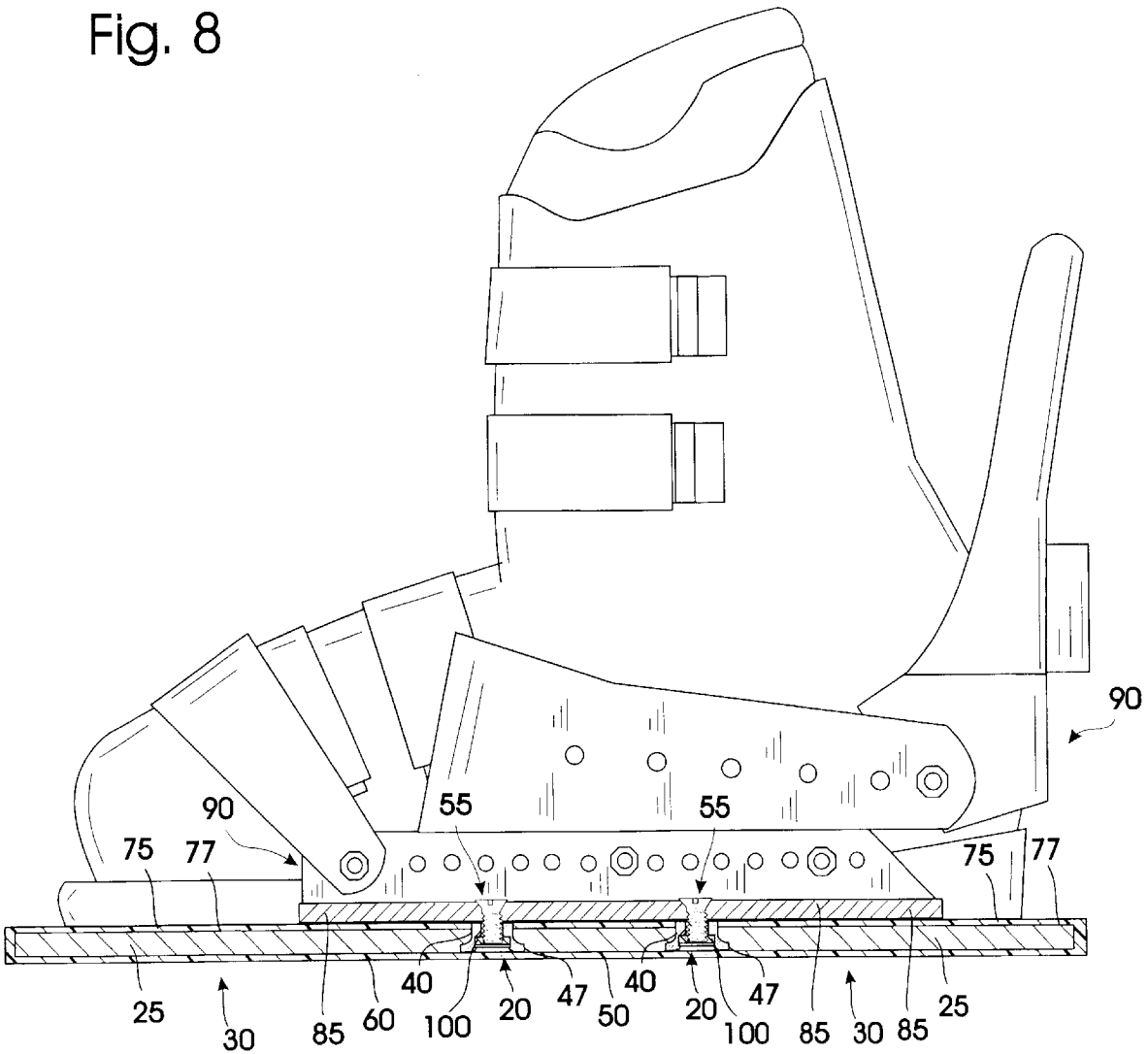
FIG. 8 is a partially fragmented side environmental view of a snowboard employing our fastener to mount a binding in place; and, FIG. 9 is a partially fragmented side environmental view of a snow ski employing our fastener to mount a binding in place.
Figure 9:
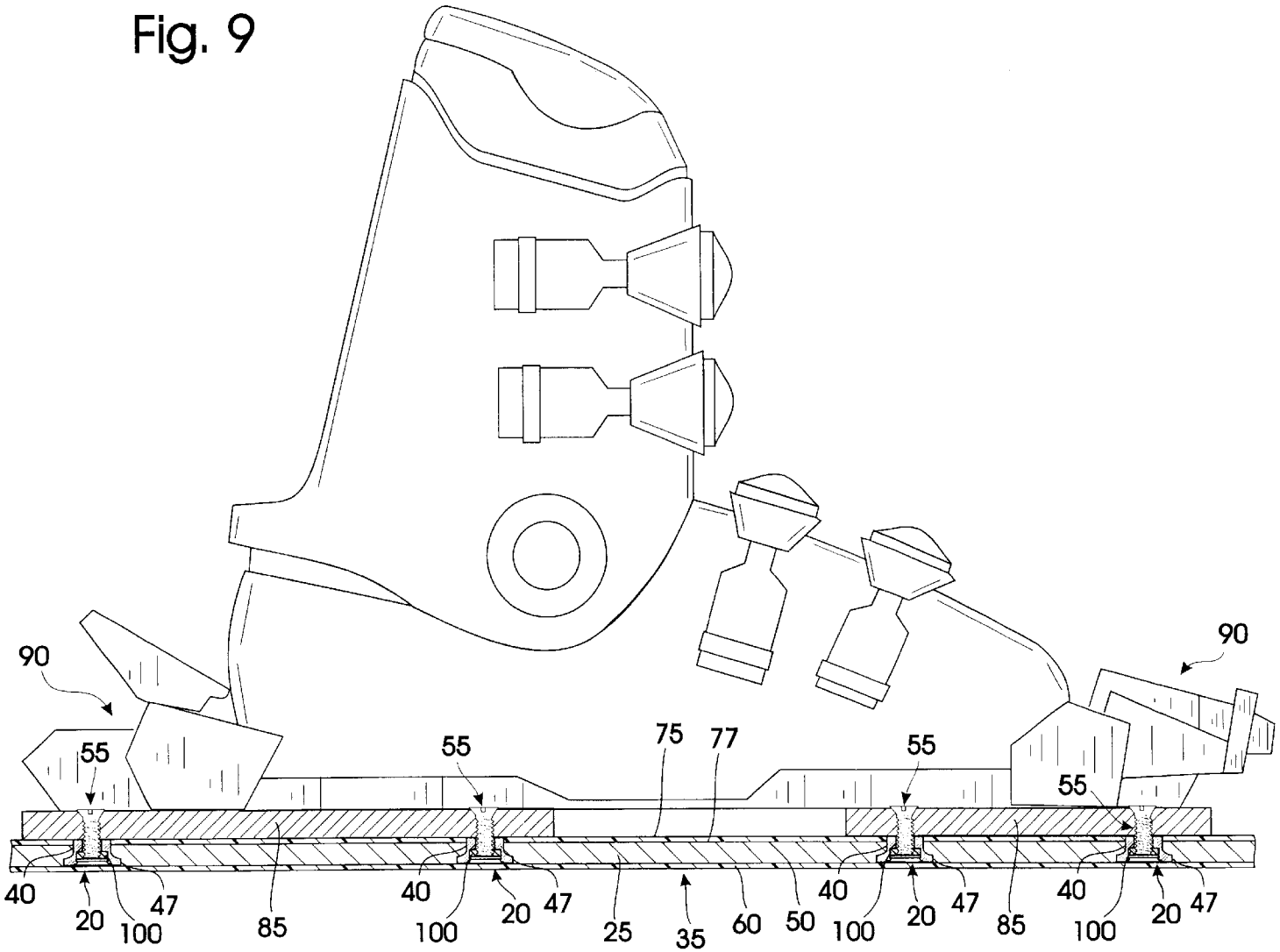

With reference now to the accompanying drawings, the preferred embodiment of our self locking fastener for use with a sportboard such as a snowboard, water ski, snow ski, boogie board, skateboard or the like is broadly designated by the reference numeral 20. Preferably, our fastener or anchor 20 is received in a countersunk bore defined in the body 25 of a snowboard 30 or ski 35. The fragmented environmental views, FIGS. 8 and 9 illustrate disposition of our anchor 20 in an inverted countersunk bore 40 in the core or center of a snowboard 30 and a ski 35, respectively. The fastener 20 fits snugly in the countersunk bore 40 with exterior surfaces of the fastener 20 in direct contact with the bore 40. So installed our anchor 20 receives the mounting screws 55 of a sportboard or ski binding 90. The anchor 20 employs a resilient insert 100 to resiliently lock the screw 55 against loosening.

Our integral resilient sportboard binding anchor 20 comprises a base 45 adapted to be received within a countersink 47 defined into the undersurface or face 50 of the core or center of a snowboard 30, ski 35 or other sportboard. The countersink 47 may be milled or it may be formed into the sportboard 30 or 35, depending on the material of the sportboard 30 or 35 and desired form of the countersink 47. The countersink 47 is in registry with the bore 40 formed to extend through the core or center and the upper covering substrate of the sportboard. The bore 40 is tapered and the countersink 47 has a shape and size selected in conjunction with the base 45 of the fastener 20 so that the core of the sportboard has a flat undersurface over which a finishing material is applied. The base 45 of the preferred embodiment of the anchor 20 has a noncircular shape to aid in preventing rotation of the anchor 20 while the binding mounting screws 55 are tightened. The preferred shape of the base 45 is generally ovoid with flat sides, as illustrated in FIGS. 1 through 6. Generally speaking, a layer of resin 60 covers the base 45 of the fastener 20. An integral ferrule 65 extends upwardly from the base 45 through the bore 40 defined in the snowboard 30 or ski 35 concentric with said countersink 47. The upper extent 70 of the anchor 20 extends through the resin layer 75 covering the top 77 of the snowboard 30 or ski 35. Internal threads 80 are defined within the ferrule 65 portion to receive a binding mounting screw 55. The screw 55 passes through the binding plate 85 into the ferrule 65 bore, holding the binding 90 in place. An internal annulus 95 is defined in the lower portion 98 of the ferrule 65. The annulus 95 is defined at the junction of the base 45 and the ferrule 65. The annulus 95 receives a generally circular resilient insert 100. A binding screw 55 threaded into the ferrule 65 of the anchor 20 contacts the resilient insert 100. The insert 100 may be in other geometric shapes which in cross section may be virtually any configuration that has an aperture into which the screw 55 of the fastener 20 can enter so that the threads of the screw 55 frictionally engage the insert which is inelastically deformed or elastically deformed to inhibit rotation of the screw 55 after installation. The insert 100 is unthreaded and is therefore deformed by the screw 55 as it is threaded into the insert 100. This locks the screw 55 in place preventing it from backing out as a result of flexure of the snowboard 30 or ski 35, vibration and lateral mechanical stresses exerted on the bindings 90 by the boarder or skier.

Preferably the insert 100 is a nylon washer or the like. In order for the insert 100 to be installed in the fastener's annulus 95, the preferred embodiment of the fastener 20 has a central orifice 105 defined in the base 45. The diameter of the orifice 105 is approximately equal to or slightly greater than the external diameter of the resilient insert 100. A shoulder 107 is defined around the edge of the orifice 105. A plate 110 is fitted into the base orifice 105 and held in place by crimping of the shoulder 107. The plate 110 holds the resilient insert 100 in place and forms a floor for the annulus 95 and the ferrule's bore. The plate 110 also defines a portion of the bottom 120 of the base 45.

The flat sided generally ovoid shape of the base 45 has several advantages over a circular shape. The ovoid base 45 is more firmly indexed in place, preventing rotation while tightening the binding screws 55. The rounded ends 125 of the base 45 do not dig into the material of the snowboard 30 or ski 35 in which the anchor 20 is embedded, as would the corners of a rectangular base, during tightening of a binding screw 55. The rounded ends 125 also provide a greater bearing area than provided by the corners of a generally rectangular base 45.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof. For example, the base 45 can be of various noncircular shapes or of a generally circular shape having indexing teeth extending outwardly from the base. Also, the fastener 20 could be formed of two parts a base 45 and ferrule 65 fitted together. It is to be understood that all matter herein set forth or shown in the accompanying drawings is to be interpreted as illustrative and not in a limiting sense.

What is claimed is:

1. A fastener for positioning in an aperture, with a countersink portion, formed in a sportboard for securing structures to the sportboard, said fastener comprising:

a base having a noncircular cross section in projection;

a ferrule extending upwardly from said base, said ferrule having a threaded aperture and having a cross section less than the cross section of said base;

a recess formed in said ferrule proximate said base;

a deformable insert positioned within said recess; and, a screw sized to threadedly engage the threads of said ferrule and to engage said deformable insert to frictionally inhibit rotation of said screw;

wherein, said cross section in projection of the base portion is perpendicular to a line passing longitudinally through the center of said base, said ferrule, said recess, and said insert.

2. A generally inverted "T" shaped, integral, self locking, sportboard binding screw anchor adapted to be embedded in the body of a sportboard to mount a binding to said sportboard, said anchor comprising:

a noncircular base portion having a cross section in projection;

a ferrule portion extending upwardly from said base portion, said ferrule portion defining internal threads intended to receive a binding screw and said ferrule portion having a cross section less than a cross section of said base portion;

an annulus portion defined internally at the junction of said ferrule portion and said base portion; and, a resilient ring disposed within said annulus portion for lockably adapted to retain said binding screw from rotation;

wherein, said cross section in projection of the base portion is perpendicular to a line passing longitudinally through the center of said base portion, said ferrule portion, said annulus portion, and said resilient ring.

3. The anchor as defined in claim 2, wherein said base portion has a generally ovoid shape.

4. The anchor as defined in claim 2, wherein said base is a polygon.

5. The anchor as defined in claim 2, wherein said base portion has two parallel sides and two opposite concentric arcs forming two opposite ends.

6. The anchor as defined in claim 5, wherein said resilient ring is formed of nylon.

7. The anchor as defined in claim 6, wherein said base further comprises a central orifice aligned with said annulus, said orifice having a diameter great enough to receive said resilient ring, said orifice having a shoulder, said orifice further receiving a bearing plate and said shoulder retaining said bearing plate in place.

8. The anchor as defined in claim 7, wherein said anchor is disposed within a countersink defined in a face of a sportboard, said ferrule extending through a bore extending upwardly from said countersink; and, wherein a top of said ferrule portion extends through resin covering said sportboard, said top flush with a top surface of said resin.

9. A generally inverted "T" shaped, resiliently self locking, integral sportboard resilient binding anchor, adapted to be received in a milled countersunk bore defined in a sportboard, said anchor comprising:

a noncircular base portion to be received within a milled countersink defined in a face of a sportboard, said base and said countersink comprising two parallel sides and two opposite concentric arcs forming two opposite ends;

a generally cylindrical integral ferrule portion extending upwardly from said base to extend through a bore defined in said sportboard, concentric with said countersink, said ferrule portion defining internal threads to receive a binding screw to secure a binding to said sportboard;

an internal annulus portion defined generally at an internal juncture of said base portion and said ferrule portion; and, a generally circular resilient insert disposed within said annulus.

10. The anchor as defined in claim 9, wherein said resilient ring is formed of nylon.

11. The anchor as defined in claim 10, wherein a bottom of said base is adapted to be disposed generally flush with said face of said sportboard and said bottom is covered by resin or the like covering said face of said sportboard.

12. The anchor as defined in claim 11, wherein a top of said ferrule extends through resin or the like covering said sportboard, said top flush with a top surface of said resin or the like.

13. The anchor as defined in claim 12, wherein said base further comprises a central orifice aligned with said annulus, said orifice having a diameter great enough to receive said resilient ring, said orifice having a shoulder, said orifice further receiving a bearing plate and said shoulder retaining said bearing plate in place.

14. A sportboard comprising:

a body having an upturned front and a relatively flat portion extending rearwardly therefrom, said body comprising a face and a top, said body having a covering of resin or the like;

a plurality of orifices extending through a center portion of said body;

a noncircular countersink defined in a face of said sportboard, concentric with each of said orifices; and, an anchor disposed within each of said orifices and said countersink, each of said anchors comprising:

a noncircular base portion comprising a bottom, said bottom disposed generally flush with a face of said sportboard;

a generally cylindrical ferrule portion extending upwardly from said base portion, said ferrule portion defining internal threads intended to receive a binding screw, said ferrule portion having a diameter less than a width of said base portion, a top of said ferrule portion extending through said resin or the like disposed on said top of said body;

an internal annular recess portion defined internally at the junction of said ferrule portion and said base portion; and, a resilient ring disposed within said annulus portion for lockably adapted to retain said binding screw from rotation.

15. The sportboard as defined in claim 14, wherein said base portion and said countersink have a generally ovoid shape.

16. The sportboard as defined in claim 15, wherein said base portion and said countersink are polygons.

17. The sportboard as defined in claim 16, wherein said base portion and said countersink has two parallel sides and two opposite concentric arcs forming two opposite ends.

18. The sportboard as defined in claim 17, wherein said resilient ring is formed of nylon.

19. The sportboard as defined in claim 18, wherein said base further comprises a central orifice aligned with said annulus, said orifice having a diameter great enough to receive said resilient ring, said orifice having a shoulder, said orifice further receiving a bearing plate and said shoulder retaining said bearing plate in place.

* * * * *